United States Patent [19]

Lande

[11] 3,998,159

[45] Dec. 21, 1976

[54] PATTERN COPYING MACHINE

[75] Inventor: Oscar Lande, Staten Island, N.Y.

[73] Assignee: Image Duplicating Systems Inc., Jamaica, N.Y.

[22] Filed: Sept. 20, 1974

[21] Appl. No.: 507,668

[52] U.S. Cl. ..... 101/131; 101/132.5; 101/472

[51] Int. Cl.[2] ..... B41L 11/12

[58] Field of Search ..... 101/130, 131, 132, 141, 101/145, 468, 472

[56] References Cited

UNITED STATES PATENTS

| | | | |
|---|---|---|---|
| 3,306,194 | 2/1967 | Cutri | 101/131 |
| 3,322,065 | 5/1967 | Procter et al. | 101/472 X |
| 3,490,367 | 1/1970 | Kaneko et al. | 101/144 |
| 3,527,165 | 9/1970 | Harless | 101/143 |
| 3,702,586 | 11/1972 | Kaneko | 101/142 |
| 3,814,013 | 6/1974 | Strauss | 101/126 X |

*Primary Examiner*—Clifford D. Crowder
*Assistant Examiner*—R. E. Suter
*Attorney, Agent, or Firm*—Amster & Rothstein

[57] ABSTRACT

A machine for copying of patterns for use in the garment industry incorporating the spirit duplicating process. The machine incorporates a pair of nip rollers between which is engaged a master pattern paper and copy paper. The copy paper is fed from a supply roll over a spirit applicator and is wrapped around the bottom nip roller, wet side out, contacts the master pattern paper at the nip, and then travels to a rewind roll. The master pattern paper travels from a supply spindle to the nip and then to a take-up spindle. The nip rollers are separated by a cam action. Control of the operations of the machine is effected by a single control arm which, in its rear position, separates the nip rollers and engages drive means to rewind the master pattern. In the forward position, the control arm brings the nip rollers together, engages drive means for the take-up spindles for the master pattern paper and the copy paper and activates the drive for the nip rollers and the spirit wetting roller.

6 Claims, 11 Drawing Figures

FIG. 5
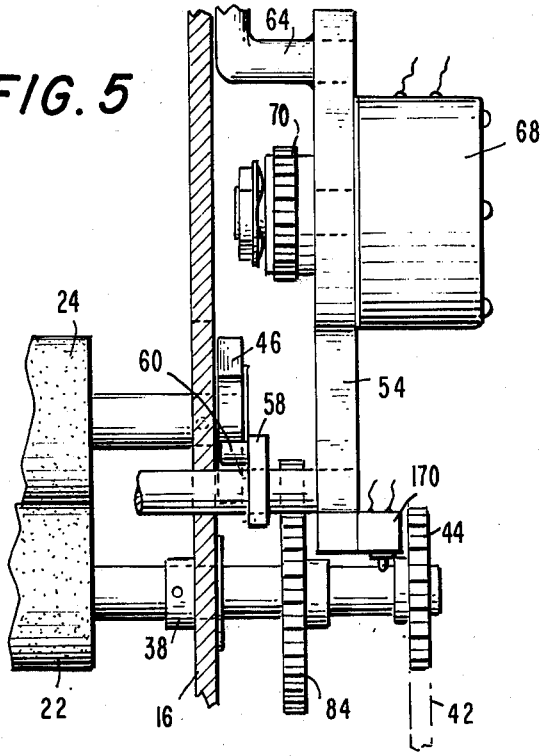
FIG. 6
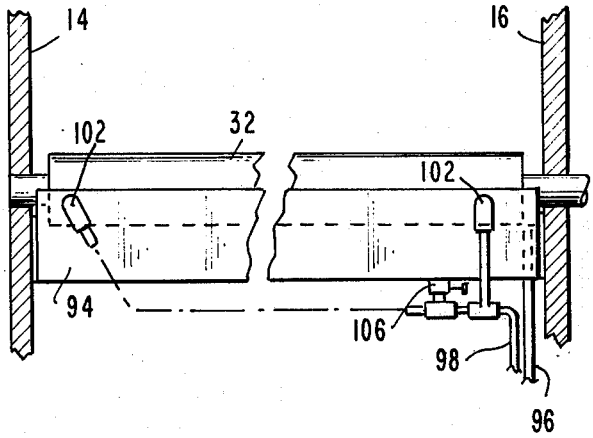
FIG. 7
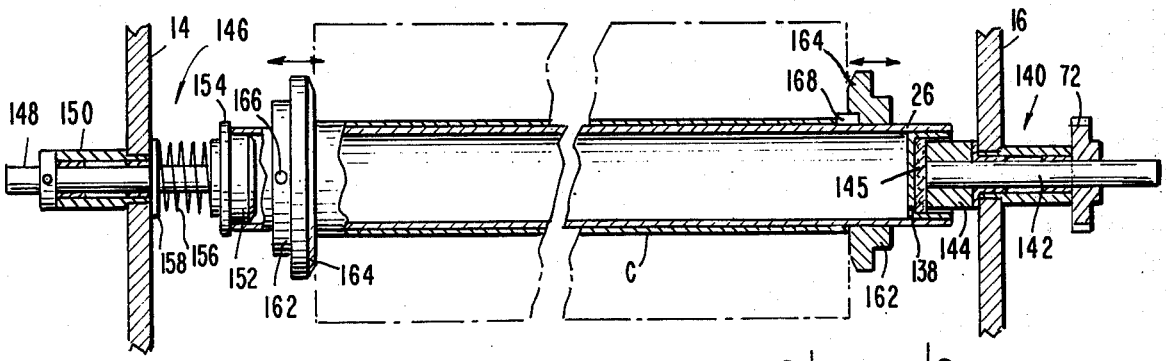
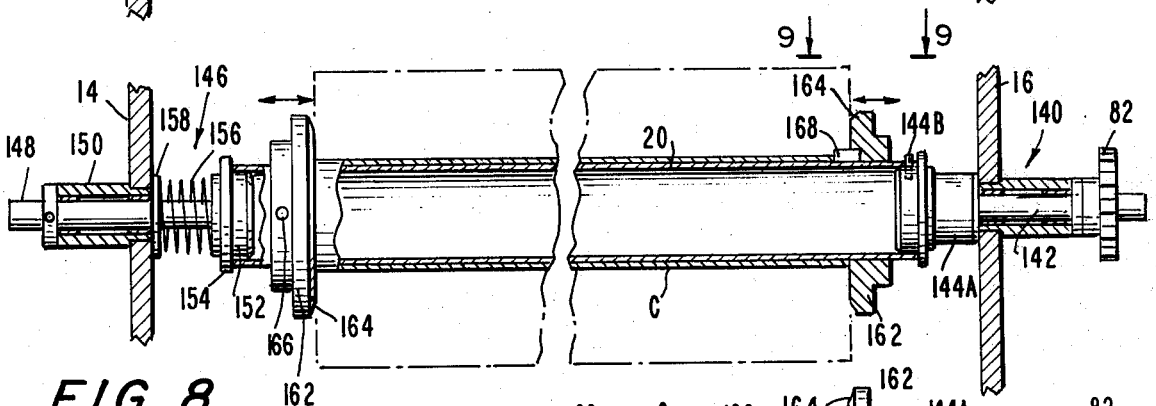
FIG. 8
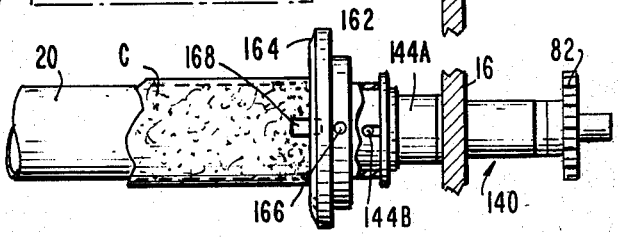
FIG. 9

FIG. 10
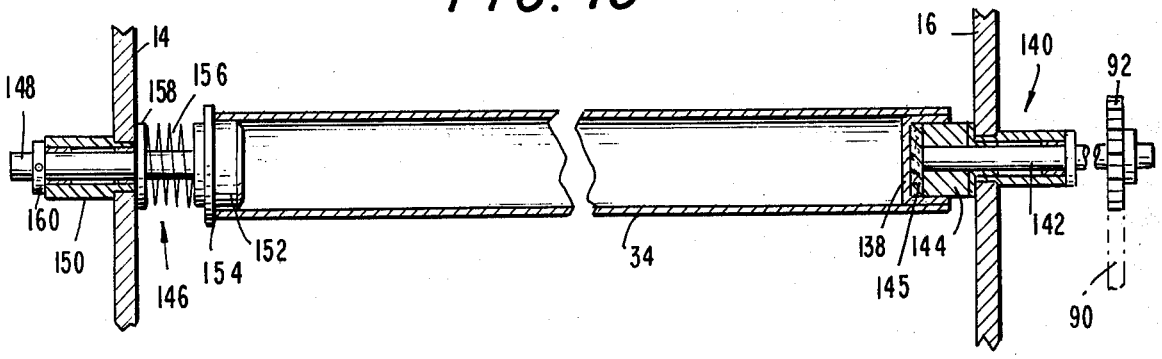
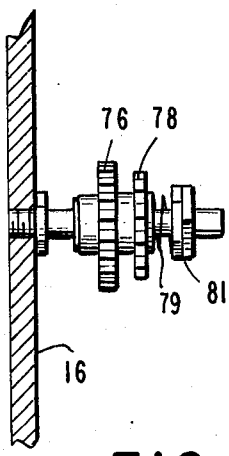
FIG. 11

PATTERN COPYING MACHINE

The present invention relates generally to duplicating machines and more specifically to a spirit duplicating machine intended for use in the garment industry to make multiple copies of garment patterns.

It is typical in the garment industry that fabric is cut into the individual pieces which comprise a garment by placing a paper pattern of those pieces on top of a multiple layered stack of fabric and then cutting that fabric with a vertically movable cutting tool. For efficiency purposes, patterns are very carefully worked out to have maximum fabric utilization with minimum waste. Of course, each time the pattern is cut, the pattern paper is destroyed, and therefore a new pattern must be produced. Such patterns are of a width equal to or greater than the width of the fabric to be cut (typically 44, 48, 54, 60 or a greater number of inches in width) and are quite long in that they accommodate the full number of component parts of the garment in the full range of sizes, sometimes with multiple numbers for the more common sizes. The reproduction processes used in such machines are varied, and the machine in accordance with the present invention employs the use of the conventional spirit duplicating process. In this process, a pattern, in mirror image, is applied to a first piece of paper by making a carbon transfer thereto, which paper then becomes the master pattern. The patterns are transferred from the master pattern paper by engagement of the carbon-bearing face against the surface of plain paper which has been wetted with a spirit such as methanol. Carbon is transferred from the master by pressure applied between rubber-covered nip rollers, and the reproduced copy is rolled up for later use.

Although the spirit duplicating process is itself very simple, prior art machines for handling the relatively large sizes of paper involved have been unnecessarily and unduly complicated and inefficient. For example, in many of the prior art machines, the master pattern was simply collected in a bin on each pass through the machine such that it had to be collected and manually replaced in the feed position. In those machines where there was an automatic rewind, the mechanisms provided were unwieldy and unnecessarily complicated. For example, in prior machines, it was required to separate the nip rollers by individual separation means at the ends of each of the rollers and then, in a separate step, engage a transport mechanism to rewind the master copy into its feed position. Furthermore, in prior art machines, an unnecessarily large number of idler rollers were employed which increased the cost of the machine, increased the difficulty of threading paper in the machine and generally interfered with the efficient and simple manufacture and use of the machine.

Accordingly, it is a general object of the present invention to provide an improved spirit duplicating machine for use in the garment industry for the production of multiple copies of garment patterns. More specifically, it is the object of the present invention to provide such a machine which is of lower cost than those previously available and which, at the same time, is both more efficient in its use, is more efficient in its productive capacity and is easier for an operator to use.

In accordance with one illustrative embodiment of the present invention, there is provided a spirit duplicating machine which has a pair of nip rollers in which one roller is driven and the other roller is mounted for movement relative to the driven roller with means for application of pressure therebetween. A master pattern transfer means is provided including a feed spindle and a take-up spindle which defines a master pattern path from the feed spindle through the nip rollers and to the take-up or rewind spindle. Means for mounting a supply of copy paper is provided and a copy paper travel path is defined from the copy paper supply to an idler roller and then to a spirit wetting roller, which wets one face of the copy paper. The copy paper is then engaged, on its other face, around one of the nip rollers and through the nip where it contacts the carbon face of the master pattern paper and then travels to a copy paper windup spindle. Cam means are provided to open and close the nip of the nip rollers controlled by a simple control arm or lever. Master drive means are provided to drive the master windup spindle during the printing stage and to drive the master feed spindle in the opposite direction during the rewind stage. Control means for the master pattern drive means comprise the same control arm which selectivity engages the drive means with the take-up spindle or the feed spindle or puts the drive means in a neutral position. Further drive means are provided for rotation of the driven nip roller, the spirit roller and the copy paper windup spindle. The control arm also controls these drive means.

The above brief description, as well as further objects, features and advantages of the present invention, will be best understood by reference to the following detailed description of one illustrative embodiment of the invention when taken in conjunction with the accompanying drawings wherein:

FIG. 5 is a sectional view taken along the line 5—5 of FIG. 1 looking in the direction of the arrows showing the mounting of the control arm, the master copy drive motor and the nip roller cam action;

FIG. 6 is a view taken along the line 6-13 6 of FIG. 3 showing the mounting of the spirit roller and the spirit trough in the machine;

FIG. 7 is a sectional view taken along the line 7—7 of FIG. 1 looking in the direction of the arrows illustrating the construction of the master paper take-up spindle and its mounting in the machine;

FIG. 8 is a sectional view taken along the line 8—8 of FIG. 1 looking in the direction of the arrows showing the construction of the master pattern feed spindle and its mounting in the machine;

FIG. 9 is a view taken from the location 9—9 in FIG. 8 showing the flange and drive arrangement on the master pattern feed spindle;

FIG. 10 is a sectional view taken along the lines 10—10 of FIG. 1 showing the construction of the copy paper take-up spindle and its mounting in the machine; and, FIG. 11 is a view taken along the line 11—11 of FIG. 1.

Figure 1:
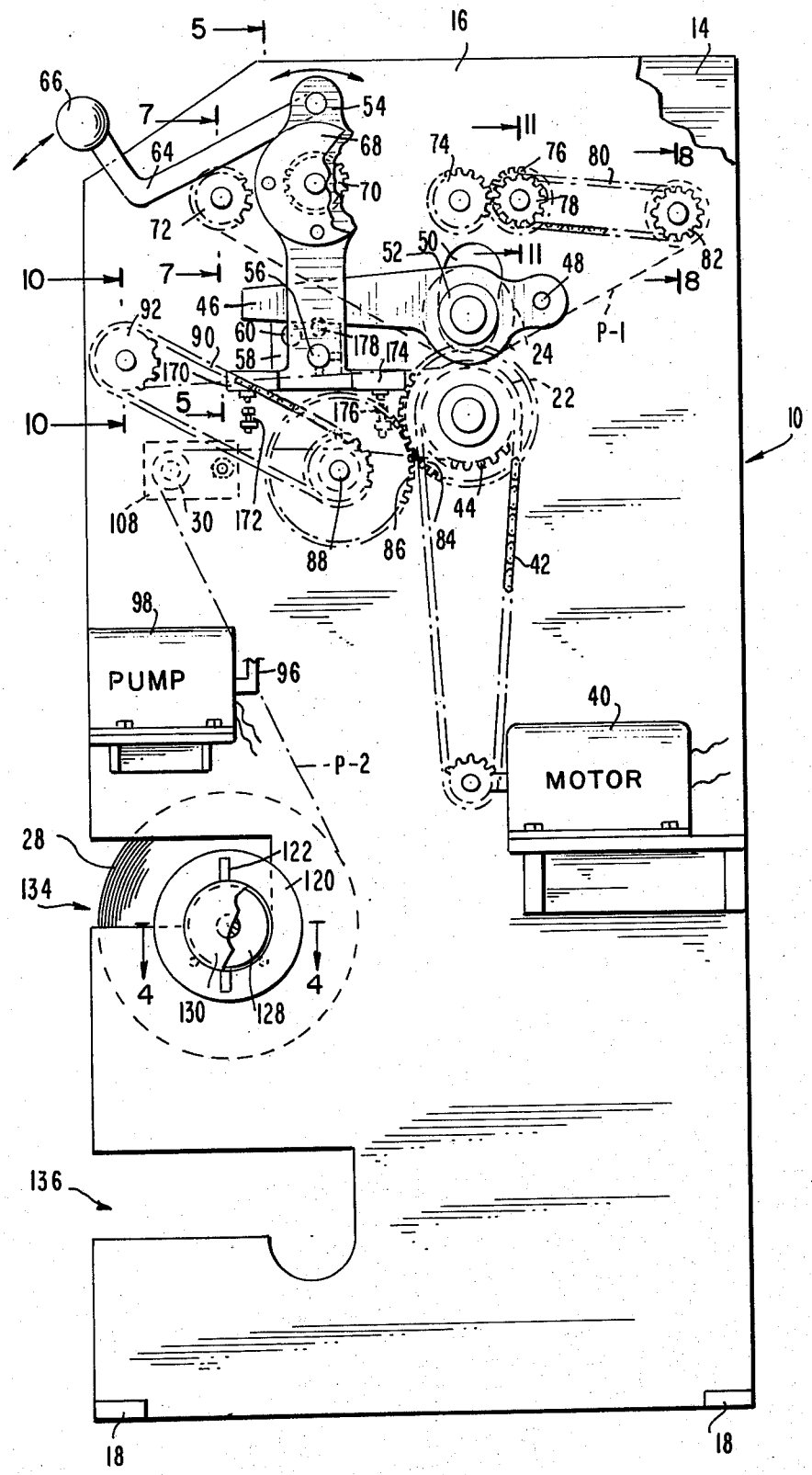
FIG. 1 is a side elevational view of the right-hand end of the machine, with portions broken away for the sake of clarity, illustrating the arrangement of the various shafts and spindles and drive mechanisms of the machine as well as illustrating the path of master pattern and copy paper through the machine.
Figure 3:
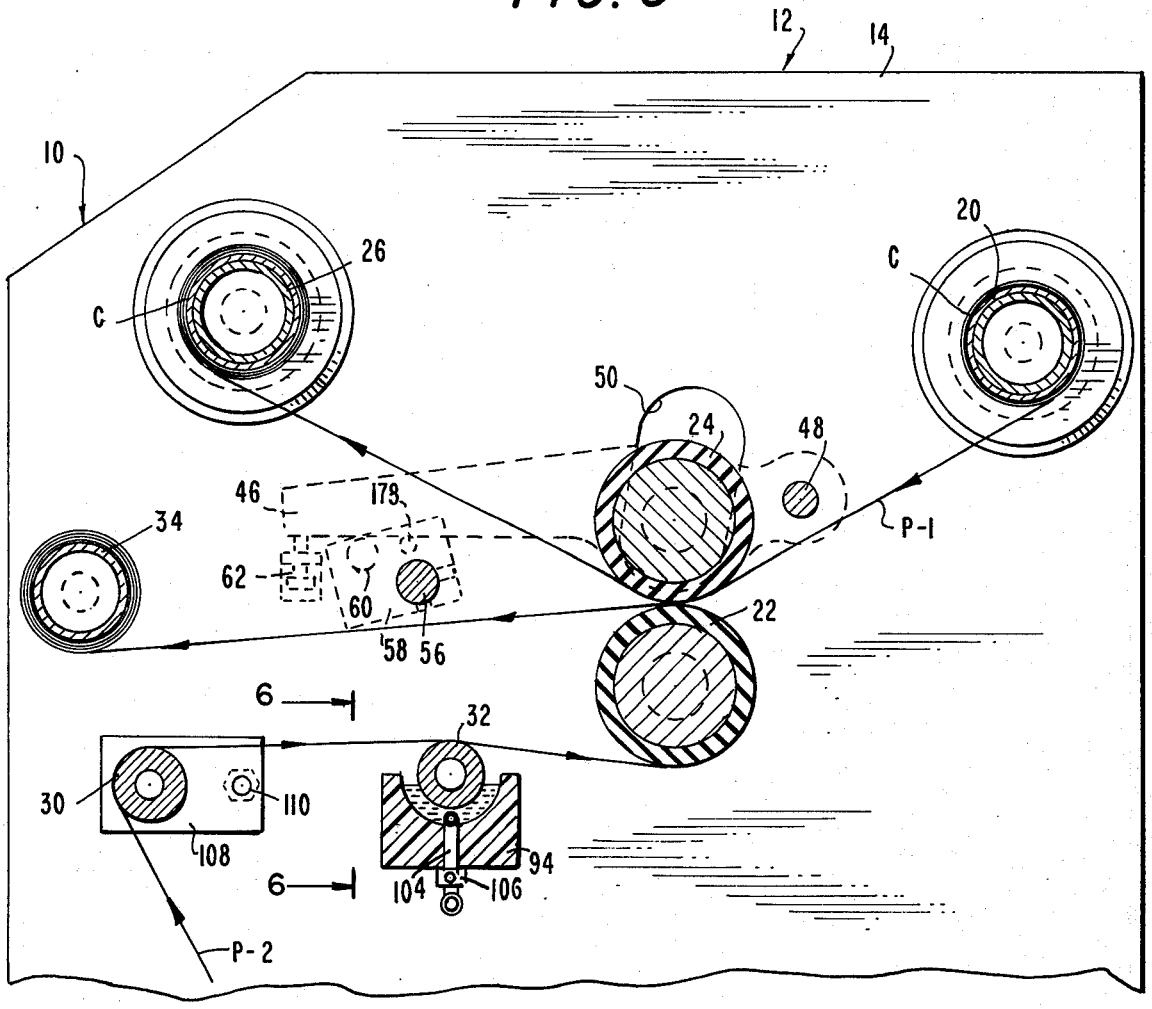
FIG. 3 is a sectional view taken intermediate the ends of the machine in a plane parallel to the plane of FIGS. 1 and 2 and illustrating the arrangement of the various rollers and spindles and showing the paths for the copy paper and the master pattern paper within the machine.
Figure 4:
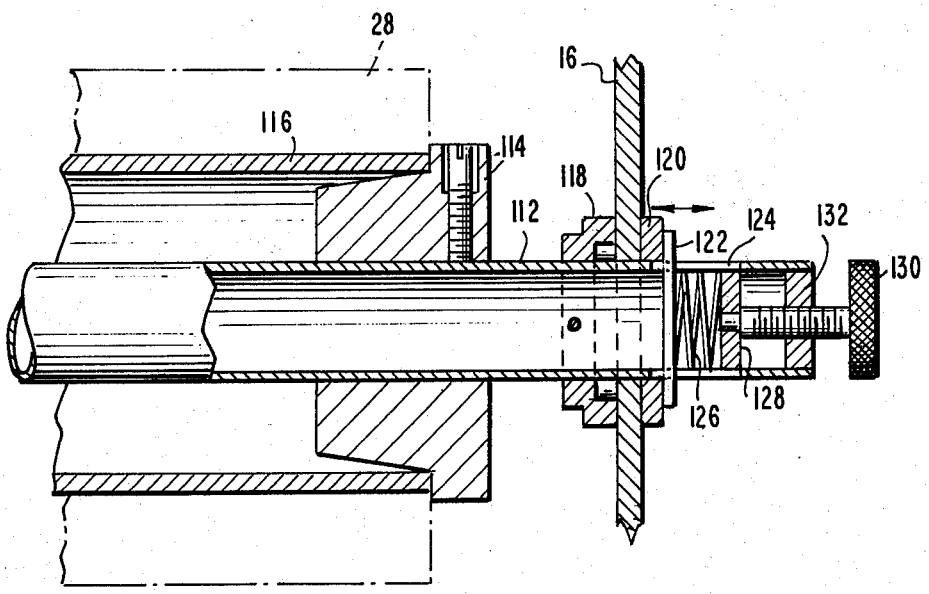
FIG. 4 is a sectional view taken along the line 4—4 of FIG. 1 looking in the direction of the arrows showing the copy paper feed roller.

Referring now to FIGS. 1 and 3 for a general description, there is shown a pattern duplicating machine generally designated by the numeral 10, the components of which are mounted in a frame 12 comprising a pair of side panels 14 (on the left side of the machine) and 16 (on the right side of the machine) with appropriate tying members such as the cross members 18 running therebetween. The components of the machine 10 provide two paths for the flow of paper through the machine. A first path for the master pattern paper is labeled P-1 and runs from the master feed spindle 20 at the upper rear of the machine to the nip between the lower nip roller 22 and the upper nip roller 24 and then to the master take-up spindle. A second feed path for the copy paper feed is labeled P-2 and runs from the copy paper supply roll 28 to an idler roller 30, to the spirit wetting roler 32, around approximately 180° around the lower nip roller 22 and then, from the nip of the nip rollers 22, 24, to the copy paper take-up spindle 34.

Prior to considering a specific description of the mechanisms which mount and drive the various spindles and rollers in the machine 10, it should be sufficient to note, for continuity of understanding, that the master pattern paper and the copy paper move at the same linear rate of speed through the nip rollers 22, 24, that the face of the copy paper which is pressed against the master pattern paper is wetted with "spirit" such as methanol immediately prior to that contact and that the master pattern take-up spindle 26 and the copy paper take-up spindle 34 are driven at a speed appropriate to wind up the respective paper as they leave the nip rollers. The drive and control mechanisms of the machine 10 are such that upon completion of the copying operation, the machine operator moves a control lever from a print to a rewind position at which the forward drive means are deactivated, the nip rollers are separated and the master feed spindle is driven in an opposite direction to transport the master pattern paper back through the master pattern feed path R1 such that the copying process can be performed in a second and then in subsequent cycles.

Figure 2:
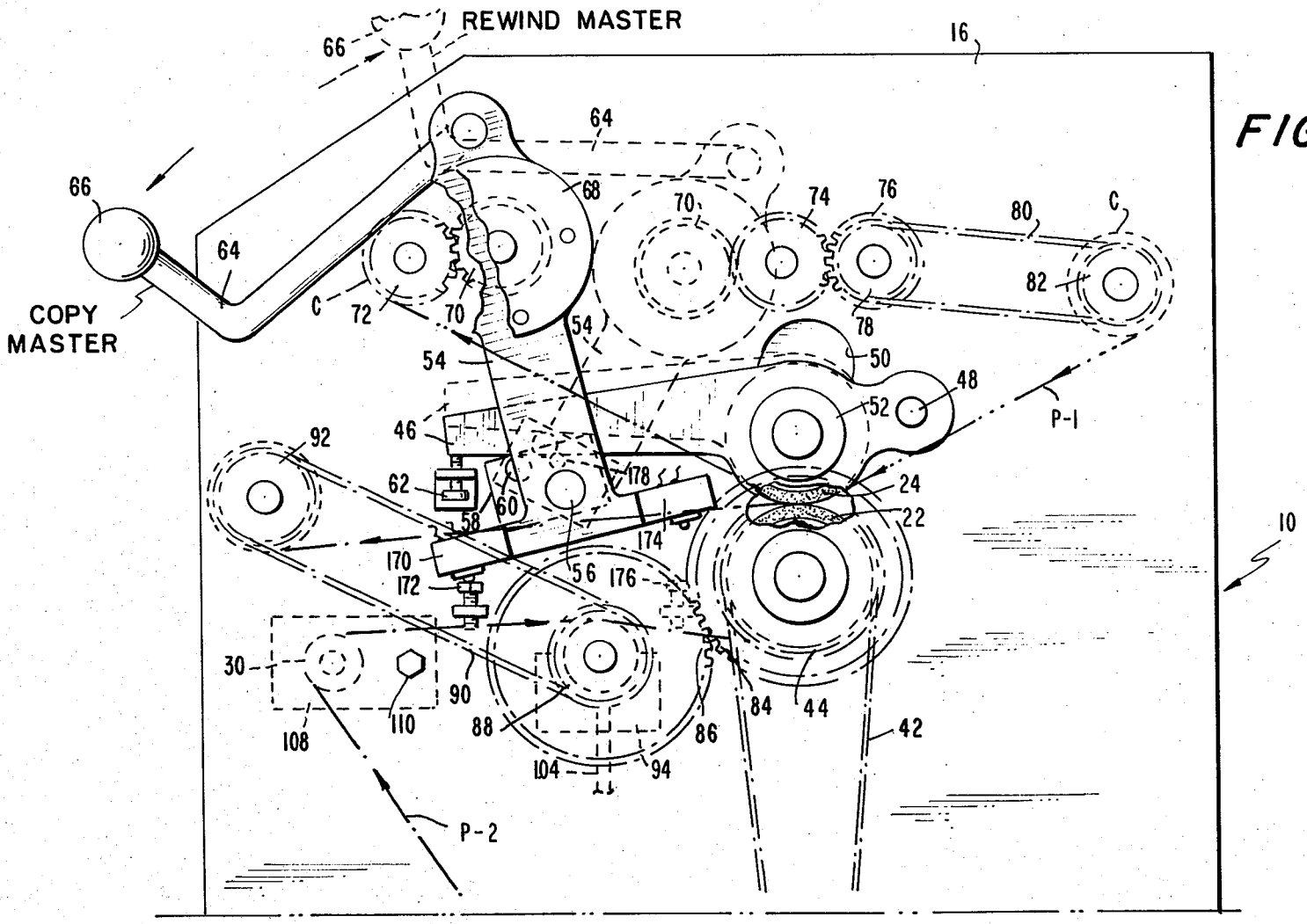
FIG. 2 is an enlarged view of the upper portion of the machine shown in FIG. 1 with further portions broken away for the sake of clarity.

A description will now be made of the mounting of the nip rollers 22 and 24 and the control of those nip rollers through the single lever control arm of the machine 10. The lower nip roller 22 is mounted in appropriate bearings 38 in the end walls 14, 16 of the frame 12 and is driven in counterclockwise rotation as seen in the drawings herein by the main drive motor 40 (and its associated gear mechanism) through the link chain 42 and the sprocket 44 connected to the shaft of the lower nip roller 22. The upper nip roller 24 is mounted on a pair of pivot arms 46 which are respectively mounted at pivots 48 on the outside faces of the end frame members 14, 16. The upper nip roller 24 extends through openings 50 in the end frame members 14, 16 and is journaled in the pivot arms 46 in appropriate bearings 52. There is no direct drive connected to the upper nip roller 24; it rotates during the printing cycle of the machine 10 by the friction forces applied to it through the paper as the paper passes under pressure through the nip of the rollers 22, 24. During the rewind cycle of the machine 10, and when the machine is in its neutral position between the printing configuration and the rewind configuration, the pivot arms 46 are elevated thus lifting the upper nip roller 24 from the lower nip roller 22 and thereby separating the nip. This action is accomplished through a main control arm 54 which is pivotally mounted on the frame 12 on the transverse control shaft 56. The control shaft runs from side to side of the machine 10 and is appropriately journaled for rotation in the end frame members 14, 16. The main control arm 54 is rigidly connected to the control shaft. Also mounted at each end of the control shaft 56 are cam action crank arms 58 which pivot with the main control arm 54. Cam pins 60 are fixed on the inner-facing surfaces of each of the crank arms 58 and engage the under surfaces of the respective pivot arms 46. When the main control arm 54 is in the print position as shown in solid line configuration in FIG. 2, the pivot arms 46 are lowered and the force of gravity is allowed to exert nip pressure between the nip rollers 22, 24. Adjustment screws 62 are provided on the frame below each of the pivot arms 46 to provide an adjustment for the distance to which the pivot arms 46 can be lowered thereby to provide an adjustment in the amount of nip pressure. In FIG. 2, the print position of the main control arm 54 is shown in solid line configuration and the rewind position is shown in dotted line configuration. The neutral position of the main control arm 54 is shown in FIG. 1. A control handle 64 and knob 66 is rigidly connected to the main control arm and forms a portion thereof and the handle and knob 64, 66 extends beyond the frame of the machine (as well as beyond a cover which is normally placed over those mechanical components which are visible in FIGS. 1 and 2).

Also mounted on the main control arm 54 is the drive means for the master pattern paper take-up and for the master pattern paper feed rewind. Specifically, there is mounted on an intermediate portion of the main control arm 54, a master pattern motor 68 (see FIG. 5) which provides its output through a slip clutch gear unit 70 which is positioned on the inner face of the master control arm 54. When the master control arm 54 is moved into the printing position, the slip clutch gear 70 of the motor 68 engages a mating gear 72 connected to the mounting means for the master take-up spindle 26. The motor 68 is energized when the control arm 54 is moved into the print position and, through the gears 70, 72, rotates the spindle 26 to take up the master pattern paper as it exits from the nip of the nip rollers 22, 24. When the main control arm 54 is moved into the rewind position, the gear 70 effectively moves the master paper feed spindle in a rewind direction through an intermediate gear 74 mounted on the end frame member 14, a mating gear 76 also mounted on the end frame and an appropriate chain and sprocket arrangement 78, 80, 82 with the ultimate sprocket 82 being attached to the mounting means for the master paper feed spindle 20. The drive from the master pattern paper motor 68 to the master pattern feed roller includes a conventional slip clutch arrangement wherein a clutch spring 79 and adjustment nuts 81 are provided to adjustably create a frictional tie between the gear 76 and the sprocket 78 thereby to allow for slippage as the effective diameter of the master pattern feed spindle 20 changes. Such an arrangement may be incorporated in addition to as a substitution for a slip clutch incorporated into the gear 70 on the motor output 68.

As explained above, the main drive motor 40 drives the lower nip roller 22. It also drives the spirit wetting roller 32 and the copy take-up spindle 34. A first gear 84 on the lower nip roller 22 is engaged with a second gear 86 rigidly attached to the spirit roller 32 which rotate in the same direction relative to the feed path P-2 and at compatible circumferential velocities. Also rigidly attached to the spirit roller 32 is a further sprocket (or pulley) 88 which, through the link chain (or pulley) 90 and the sprocket (or pulley) 92 mounted on the mounting means for the copying paper take-up spindle 26, effectively drive the copy paper take-up spindle 26 in the proper direction and with sufficient speed to take up the copy paper as it leaves the nip of the rollers 22, 24. An appropriate slip clutch is provided either at sprocket 88 or sprocket 92 to accommodate for speed variations as the radius of the take-up spindle changes.

The spirit roller 32 is of conventional construction and rides in a trough 94 such that its lower portion is constantly in a bath of spirit such as methanol. The general configurations of the trough can be best seen in FIGS. 3 and 6 and include a spirit feed line 96 and a discharge line 98. The feed line 96 runs from a pump 98 such that a continuous supply of spirit is fed to the trough. Level governing drain ports 102 are provided to establish the upper level of spirit in the trough and to drain off any additional fluid. A full drain line 104 is provided at the base of the trough with an appropriate drain valve 106 to allow the operator to completely drain spirit from the trough 94 when the machine 10 is not in use.

The idler 30 is mounted for free rotation on a pair of adjustment arms 108 which are adjustably bolted at 110 to the inner faces of the end frame members 14, 16. By adjustment of the position of the adjustment arms 108, the idler roller 30 can be moved up and down thereby to adjust the angle of approach of copy paper to the spirit wetting roller and to adjust the pressure of the copy paper as it contacts the wetting roller.

Prior to a description of the cycles of operation of the machine 10, a brief description will be given to the details of the construction of the master take-up and feeds spindles, the copy paper take-up spindle, the copy paper feed spindle and other mechanical arrangements in the machine 10.

The copy paper feed spindle 112 mounts the copy paper supply roll 28 at the lower front portion of the machine and provides a controlled braking force to provide some tension in the copy paper in its path P-2 and to prevent the copy paper roll from freely unrolling. The spindle is a simple tube on which is mounted a pair of flanges 114 which engage the typical core 116 of a roll of paper such as the roll of copy paper 28. The spindle 112 extends through the end frame member 16 and is journaled for rotation therein and is provided with means to provide a drag or braking force against the end frame member. Specifically, a bushing 18 is fixed to the spindle 112 on the inside surface of the end member 16 and a friction washer 120 is positioned around the spindle 112 and bears against the outside of the end frame member 16. A pin 122 extends through a slot 124 in the spindle 112 and provides pressure against the friction washer 120 through a spring 126 and backup plate 128. The compression of the spring 126 is adjustable by means of a screw knob 130 threaded in the fixed block 132 attached to the end of the spindle as the screw knob 130 is turned in a clockwise direction, the compression of the spring 126 is increased thereby increasing the frictional drag of the copy paper supply spindle 112. As can be seen in FIG. 1, the copy paper supply spindle 112 is fitted into one of two paper receptacles 134, 136 located at the lower front of the machine 10. A spare roll can be kept at location 136. It will be appreciated that a relatively easy movement into and out of the receptacles 134, 136 may be made due to the construction of the spindle 112 as described above.

The copy paper take-up spindle 34 is shown in FIG. 10. It simply consists of a thin hollow tube manufactured of a material such as aluminum and has a spindle-mounting receptacle 138 at one end, and the other end is open. A spindle mount 140 is provided in the end frame member 16 and comprises an axle 142 mounted in appropriate bearing means fixed to the end frame member with a male attachment member 144 on the inside end of the axle 142. The male mounting member 144 is received into the receptacle 138 of the spindle 26, and pressure exerted axially by the spindle 34 toward the end member 14 frictionally transmits rotational force from the axle 142 to the spindle 34 through the pad or brake material 145. Sprocket member 72 from the drive mechanisms is attached to the axle 142 to provide the take-up rotation of that spindle. A spring-loaded mount 146 is provided at the other end of the spindle 34 and comprises a shaft or axle 148 mounted in a bearing member 150 for both rotational movement and some axial movement. The end of the shaft 148 is provided with a plug 152 which is compatible with the inside diameter of the spindle 34 and which has a collar 154 of a larger diameter such that the plug may be inserted into the spindle 34 to a certain depth limited by the collar 154. A spring 156 is provided between the plug 152 and the inner wall of the end frame member 16, with a washer 158 therebetween, thus biasing the shaft 148 and plug 152 in a direction inwardly of the machine. Movement of the shaft 148 is limited by the pinned collar 160 on the outer end of the shaft 148 which collar butts against the outside of the bearing member 150. The spindle 34 is mounted in the machine 10 by pressing its open end over the plug 152 and pushing the plug 152 against the bias force of the spring 56 to a point such that the other end of the spindle clears the face of the male mounting member 144 on the end frame member 14. That end of the spindle is then moved to be coaxial with the mounting unit 140 and the operator allows the spring bias to push the open-ended spindle-mounting receptacle 138 over the plug 144 to complete attachment of the spindle. The spindle is removed from the machine by the opposite process.

The master pattern take-up spindle 26 and the master pattern feed spindle 20, as shown in FIGS. 7 and 8, are each mounted within the end frame members 14, 16 by spindle mounts 140 at the right-hand end of the machine and spring-loaded mounts 146 at the left-hand end of the machine, each of the same construction as described above. Accordingly, a description of the details of those units will not be repeated here, except that one exception should be noted. It has been found that a somewhat different construction may be advantageous for the mounting plug 144 for the master pattern rewind spindle 20 and therefore the plug has been designated in that instance as 144A. It should be noted that there is provided a plug which fits into the end of the tubular master feed spindle of a larger diameter than that of the plugs 144, thereby eliminating the requirement for the spindle-mounting receptacle 138 and thereby easing the engagement and disengagement of the spindle from the machine. Specifically, the enlarged plug end of element 144A is provided with a pin 144B which is engaged in an appropriate notch formed in the end of the tubular spindle 20 in order to ensure a direct drive between the spindle-mounting means 140 and the spindle 20. The master pattern paper spindles 20, 26 are also provided with adjustable flanges 162 with inclined inner faces 164. The flanges are slidably mounted on the spindles 20, 26 and can be fixed in their proper longitudinal position by means of the lock screws 166. The two right-hand flanges 162 are provided with a lug or key 168 which can be used to engage a notch in a cardboard core positioned over the spindles 20, 26. Specifically, it has been found helpful to provide conventional cardboard cores C over the tubular metal portions of the spindles 20, 26 for ease of handling when the master paper is taken from or applied to the machine 10. The cores are normally about the same length as the width of the master pattern paper or slightly less than the width thereof and the flanges are positioned to engage the ends of the cardboard cores or to be positioned closely spaced therefrom such that the inclined surfaces of the flanges 64 serves to keep in alignment the master pattern paper as it moves through the machine 10.

The control arm 54 also controls the energization of the motors 40 and 68. Specifically, when the control arm is in its forward or printing position as shown in solid lines in FIG. 2, a first microswitch 170 on the arm is engaged against an adjustable switch-tripping screw 172 and is effective to energize both the master pattern paper take-up motor 68 and the main drive motor 40. As soon as the control arm 54 is moved out of its print position, the microswitch 170 is disengaged from the tripping screw 172 deactivating those two motors. When the main control arm 54 is moved all the way to its rearward position as shown in dotted lines in FIG. 2, a second microswitch 172 is engaged with a second adjustable switch-tripping screw 176 which is effective to energize the master pattern paper motor 68 to power the rewind of the master pattern paper spindle 20.

A more complete understanding of the machine in accordance with the present invention will be obtained by considering the following description of a cycle of operation of the machine. With the machine elements in their neutral position, i.e., the position as shown in FIG. 1, the nip rollers are separated. Conventional detent means are used to define the intermediate position and, in the specific case shown, detent pins 178 mounted on crank arms 58 provide this function when they are engaged in coplimentary notches formed in the bottom of the pivot arms when they are engaged in a notch formed in the lower faces of the pivot arms 46. When the operator grasps the knob 66 and the handle 64 and pulls same forwardly to the copy position as shown in FIG. 2, the cam pins 60 allow the pivot arm 46 to lower, thus lowering the upper nip roller 24 onto the lower nip roller 22 to exert nip pressure on the copy paper and master pattern paper therebetween. Simultaneously, the energization of the main drive motor 40 and the master pattern paper motor 68 is effected through the microswitch 172. The nip rollers are driven to pull the two layers of paper through the nip along the paths P-1 and P-2. The copy paper is pulled from the copy paper supply roll 28 over the idler roller 30 and over the spirit wetting roller 32 which is effective to apply a coating of methanol to the lower face of the copy paper. That wet face of the copy paper is then pressed against the face of the master pattern paper at the nip of the rollers 22, 24 and carbon from the master is transferred to the copy paper. The copy paper then travels to the copy paper take-up spindle 34 which is driven under influence of the main drive motor 40. Simultaneously, and at the same linear speed, the master pattern paper is moving along path P-1 and is taken up on the master take-up spindle 26 under influence of the master pattern paper motor 68. When the full length of the master pattern paper is copied, or when so much of it is copied as is desired, the operator moves the control knob into the neutral position to cease operations or moves it all the way to the rewind position to effect rewind of the master. As soon as the main control arm 54 is moved out of the copying position, the microswitch 170 is deactuated thus deenergizing both motors and halting movement of both the copy paper and the master paper. When the control arm is moved out of the print position, the cam pin 60 also raises the pivot arm 46, thus opening the nip between the rollers 22, 24. When the arm is moved into the rewind position, the motor 68 is again energized but in this position it is connected not to the master take-up spindle 26, but to the master feed spindle 20 in its rewind configuration and thus causes the master feed spindle 20 to rotate in a counterclockwise direction to rewind the master either all the way or to whatever extend the rewind is desired. The control arm 54 is then moved back either to its neutral position to halt operations or to its copying position to repeat the copying cycle.

It should be understood that the specific mechanisms disclosed in the drawings and described above are illustrative of a wide variety of standard expedients which can be used to accomplish the basic structural arrangement of which the machine 10 is one illustrative example. Various forms of spindles, spindle-mount means, slip-clutch means and drive means may be utilized in substitution for those specifically described herein, and those skilled in the art will understand that such substitutions can be freely made within the general concept of the disclosed invention.

What I claim is:

1. A garment pattern copying machine comprising:

1. a frame;
2. a pair of rubber-covered nip rollers mounted on said frame for rotational movement;
3. means mounting at least one of said nip rollers for movement toward and away from the other nip roller;
4. a single control arm for controlling the operation of said machine, said control arm being movable relative to said frame to a print position, a neutral position and a rewind position;
5. nip roller control means connected between said control arm and said at least one movable nip roller for causing relative movement of said nip rollers to come together when said control arm is moved into said print position and to separate when said control arm is moved into said neutral and rewind positions;
6. a master pattern paper feed spindle and a master pattern paper take-up spindle mounted on said frame and defining, with said nip rollers, a master pattern paper feed path;

7. copy paper feed means mounted on said frame including a copy paper feed spindle for mounting a supply of copy paper;
8. a spirit wetting means for wetting one surface of said copy paper mounted on said frame at a location between said copy paper feed means and said nip rollers and adjacent to said nip rollers;
9. a copy paper take-up spindle mounted on said frame for receiving copy paper after it has passed through said nip rollers;
10. said copy paper feed means, spirit wetting means, nip rollers and copy paper take-up spindle defining a copy paper feed path in said machine;
11. drive means connected to at least one of said nip rollers, to said master pattern paper feed spindle, to said master pattern paper take-up spindle and to said copy paper take-up for rotating same during the operation of said machine; and
12. drive control means including electromechanical switch means interconnecting said control arm and said drive means for (a) energizing said drive means and driving said master pattern paper take-up spindle, said copy paper take-up spindle and said nip rollers only in response to movement of said single control arm into said print position and when said nip rollers are moved together and for (b) energizing said drive means and driving said master pattern paper rewind spindle only in response to movement of said single control arm into said rewind position and when said nip rollers are separated.

2. A garment pattern copying machine in accordance with claim 1 wherein said spirit wetting means includes a spirit wetting roller and spirit supply means for supplying spirit to said spirit wetting roller, wherein said driving means is connected to said spirit wetting roller for rotating same and wherein said drive control means is effective to cause said drive means to rotate said spirit wetting roller when said control arm is in said print position.

3. A garment pattern copying machine in accordance with claim 1 wherein said rubber-covered nip rollers are of substantially the same diameter and positioned one above the other in said frame and the upper one thereof is mounted for vertical movement and said nip roller control means includes a cam mechanically connecting said upper nip roller to said control arm and moves upwardly responsive to movement of said control arm out of said print position to separate it from the lower nip roller.

4. A garment pattern copying machine in accordance with claim 1 wherein said nip roller control means comprises mechanical means connected to one of said nip rollers to cause relative movement of one of said nip rollers away from the other when said control arm is moved from said print position toward said neutral position.

5. A garment pattern copying machine in accordance with claim 4 wherein said drive means includes electrical motors and said drive control means includes electrical switches for energizing and de-energizing said motors responsive to the position of said control arm.

6. A garment pattern copying machine in accordance with claim 5 wherein said master pattern paper feed spindle, said master pattern paper take-up spindle, said copying paper feed means, said copying paper take-up spindle and said single control arm are positioned within said frame such that they are all both visible from and accessible from the front of said machine.

* * * * *